United States Patent [19]

Scholl et al.

[11] Patent Number: 4,991,527

[45] Date of Patent: Feb. 12, 1991

[54] METHOD OF ATTACHING A STRIP OF CLOTH WITH A ZIP-FASTENER COMPONENT TO A TROUSER FOREPART

[75] Inventors: Hans Scholl, Oerlinghausen-Lipperreihe; Siegfried Vogt, Leopoldshöhe, both of Fed. Rep. of Germany

[73] Assignee: Kochs Adler Aktiengesellschaft, Fed. Rep. of Germany

[21] Appl. No.: 430,793

[22] Filed: Nov. 2, 1989

Related U.S. Application Data

[62] Division of Ser. No. 336,210, Apr. 11, 1989, Pat. No. 4,911,091.

[30] Foreign Application Priority Data

Apr. 14, 1988 [DE] Fed. Rep. of Germany ..... 3812800

[51] Int. Cl.[5] ..... D05B 3/12; D05B 21/00

[52] U.S. Cl. ..... 112/265.2; 112/104; 112/113; 112/121.15; 112/147

[58] Field of Search ..... 112/265.2, 265.1, 104, 112/113, 114, 121.27, 147, 152, 153, 262.3, 121.15, 121.12, 70, 76, 311

[56] References Cited

U.S. PATENT DOCUMENTS

| | | | |
|---|---|---|---|
| 4,534,067 | 8/1985 | Richardson | 112/265.2 X |
| 4,593,635 | 6/1986 | Boser et al. | 112/114 X |
| 4,644,886 | 2/1987 | Miyakawa | 112/265.2 |
| 4,660,821 | 4/1987 | Boser et al. | 112/265.2 X |
| 4,685,407 | 8/1987 | Junemann | 112/121.12 X |
| 4,854,251 | 8/1989 | Hiramatsu et al. | 112/265.2 X |
| 4,869,185 | 9/1989 | Scholl et al. | 112/114 X |
| 4,870,918 | 10/1989 | Hiramatsu et al. | 112/265.2 |

*Primary Examiner*—Peter Nerbun

*Attorney, Agent, or Firm*—Laff, Whitesel, Conte & Saret

[57] ABSTRACT

To attach a strip of cloth provided with a zip-fastener component to each of two trouser foreparts, the edge of the trouser forepart is folded over before being joined to the strip of cloth. The trouser forepart with the folded-over edge and the strip of cloth are positioned relative to one another in a position which they occupy after being sewn together. Subsequently, this sewing takes place in a clamping fixture in a single sewing operation. The purpose of this measure is to attach the strip of cloth and zip-fastener component to a trouser forepart with the minimum possible effort.

4 Claims, 9 Drawing Sheets

FIG.15
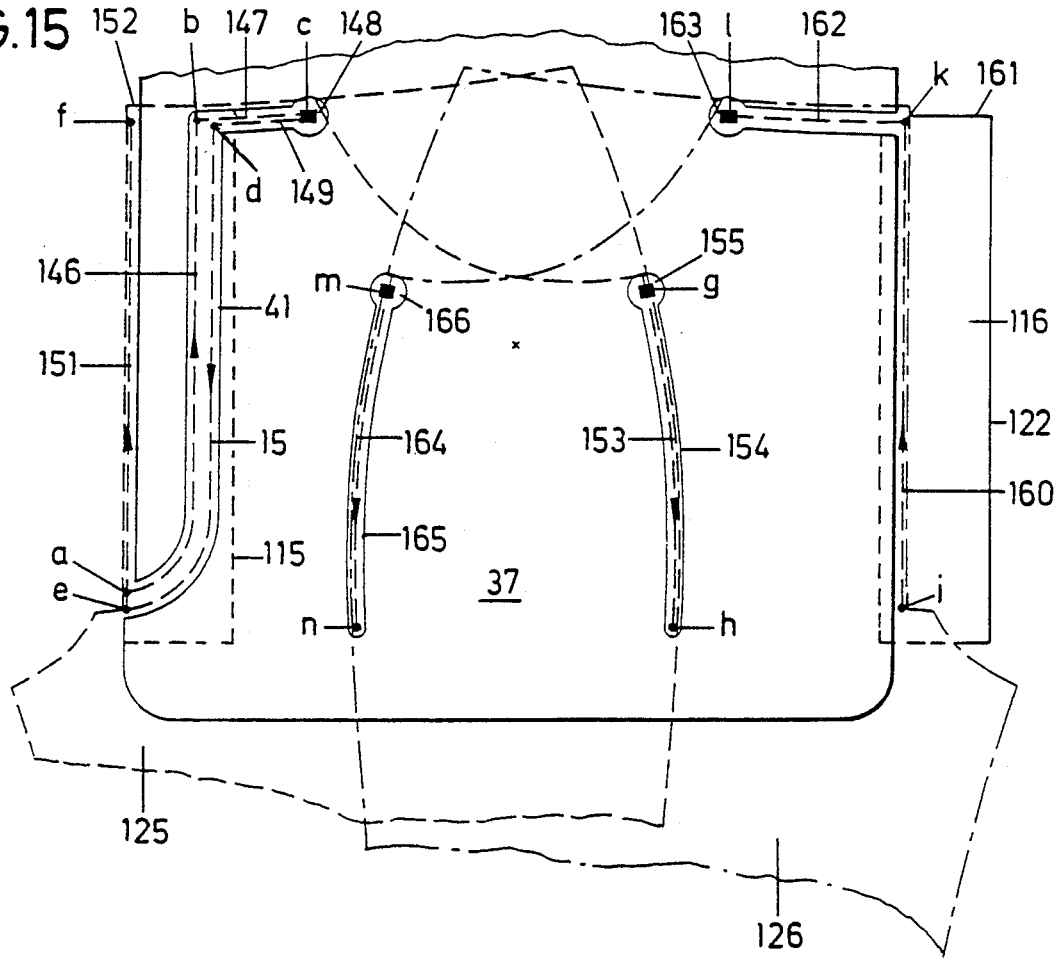
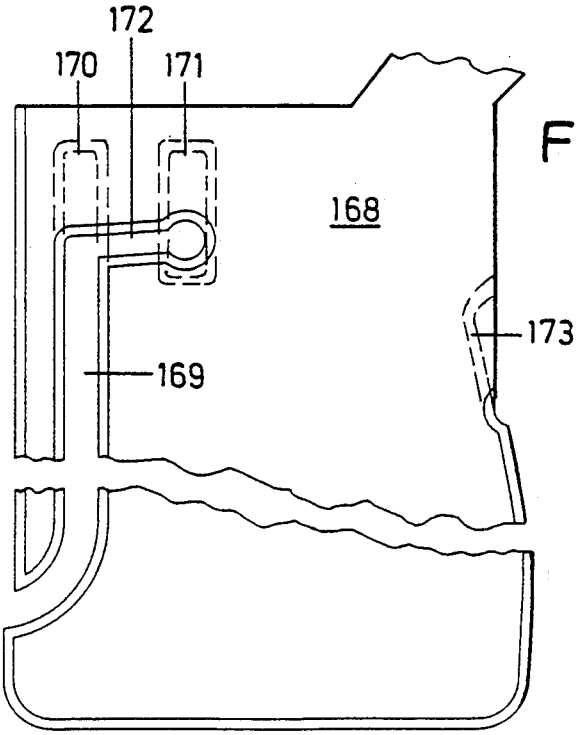
FIG.16

METHOD OF ATTACHING A STRIP OF CLOTH WITH A ZIP-FASTENER COMPONENT TO A TROUSER FOREPART

This is a divisional application of our patent application Ser. No. 07/336,210, filed Apr. 11, 1989, now U.S. Pat. No. 4,911,091.

FIELD OF THE INVENTION

The invention relates to the attaching of a strip of cloth provided with a zip-fastener component to each of two trouser foreparts, an edge of the trouser forepart being folded over and the strip of cloth being joined to the trouser forepart at least in the area of the folded-over edge by means of a seam and to a sewing unit for performing this operation.

BACKGROUND OF THE INVENTION

It is known practice from the publication of Pfaff Industriemaschinen GmbH entitled "PFAFF 200-04 Special Service" to sew together the associated strip of cloth on a left trouser forepart, the so-called left fly lining, and the associated area of the trouser forepart. The sewn-on strip of cloth is then folded over and the associated zip-fastener half, i.e. the left zip-fastener component, is sewn on. This strip of cloth is subsequently folded over again and the left joining seam is produced between the strip of cloth and the trouser forepart. Also, the sewing of the right strip of cloth having the right zip-fastener component, i.e. the associated zip-fastener half, on to the right trouser forepart takes place in several work cycles.

It is known practice from U.S. Pat. No. 4,534,067 to manufacture trouser flies in such a manner that an additional strip of cloth is also cut in one piece with each of the two trouser foreparts in the fly area and is then folded over and sewn together with the trouser forepart. In addition, a zip-fastener half, i.e. a zip-fastener component, is also sewn on. In the case of the left trouser forepart the outer edge is pressed inwards so that a four-layered design is formed in this case which is then stitched.

SUMMARY OF THE INVENTION

It is an object of the present invention to create a method of the type as defined which enables a strip of cloth and zip-fastener component to be attached to a trouser forepart with the minimum possible work, and to specify a sewing unit for putting this method into practice.

This problem is solved in accordance with the invention by a method of attaching a strip of cloth provided with a zip-fastener component to each of two trouser foreparts, an edge of the trouser forepart being folded over and the strip of cloth being joined to the trouser forepart at least in the area of the folded-over edge by means of a seam, wherein the edge of the trouser forepart is folded over before being joined to the strip of cloth, wherein the trouser forepart with the folded-over edge and the strip of cloth are positioned relative to one another in a position which they occupy after being joined together, and wherein the joining by means of a seam is effected in a single sewing operation. In the method according to the invention each trouser forepart and a strip of cloth provided with a zip-fastener component are each therefore brought into their final form, for example by folding, and moved into their final position relative to one another and then sewn together in a single operation. Manipulation of cloth layers which has to be carried out between several sewing operations is therefore unnecessary as a result of which the time spent on sewing and also the expenditure on sewing thread are reduced. The production of continuous strips of cloth, which are connected to zip-fasteners and are then separated to form individual sections to be used in accordance with the invention, is known for example from U.S. Pat. No. 4,362,116.

When an edge of the strip of cloth is folded over and brought into mutual contact with the folded-over edge of the trouser forepart, before the trouser forepart and strip of cloth are positioned relative to one another, it is possible also to sew in a folded-over edge of the cloth strip provided with the zip-fastener component without there being an appreciable increase in the time required for this operation. The method according to the invention makes possible, in a particularly advantageous manner, a development according to which the at least two, and as a rule even three seams, which run parallel to one another and to the zip-fastener component and which include the necessary cross seams and the, if required, seam lock, can be produced in the form of a single continuous seam having a plurality of turning points. In particular, the J-shaped seam which, partly for fashion reasons, is in the form of a double seam and therefore has a bent end in the lower section can in this case also be sewn in the course of a continuous seam.

In addition, the method according to the invention makes it possible to produce even other seams in spatial proximity in the work holding fixture necessary for producing the continuous seam.

The problem underlying the invention is further solved by a sewing unit for attaching a strip of cloth provided with a zip-fastener component to each of two trouser foreparts, comprising a sewing machine and a feeding device with a workpiece holder which is movable relative to the sewing machine, wherein there is provided a preparatory station which has a device for positioning a strip of cloth provided with a zip-fastener component, a sword for receiving a trouser forepart and a trouser part folding device for folding an edge of the trouser forepart around the sword, wherein the device for positioning the cloth strip, the sword and the trouser part folding device can be brought over and on top of one another, and wherein there is provided a device for the combined transfer of a trouser forepart and of a cloth strip to the sewing machine, which trouser forepart and which cloth strip have been positioned relative to one another. The fundamental design of the preparatory station can be seen in that there is provided a device for positioning the cloth strip provided with a zip-fastener component, and that above this device there are provided a sword for receiving the trouser forepart and a trouser part folding device for folding an edge of this trouser forepart around the sword, and that the sword and trouser part folding device can be lowered on to the device for positioning the strip of cloth.

When the preparatory station and the sewing machine are connected to one another by means of a continuous bearing plate, and when the combined transfer of the trouser forepart and the cloth strip takes place on the bearing plate, this serves to facilitate the transfer of the parts situated in their final position for sewing, i.e. the trouser forepart and the strip of cloth to the sewing machine.

Further advantages and features of the invention will become apparent from the ensuing description of an exemplary embodiment, taken in conjunction with the drawings.

BRIEF DESCRIPTION OF THE DRAWINGS

FIG. 15 shows a workpiece holder for guiding and sewing together left and right trouser foreparts with cloth strips, FIG. 16 shows a workpiece holder which is suitable only for left trouser foreparts of different sizes.

DESCRIPTION OF THE PREFERRED EMBODIMENT

Figure 1:
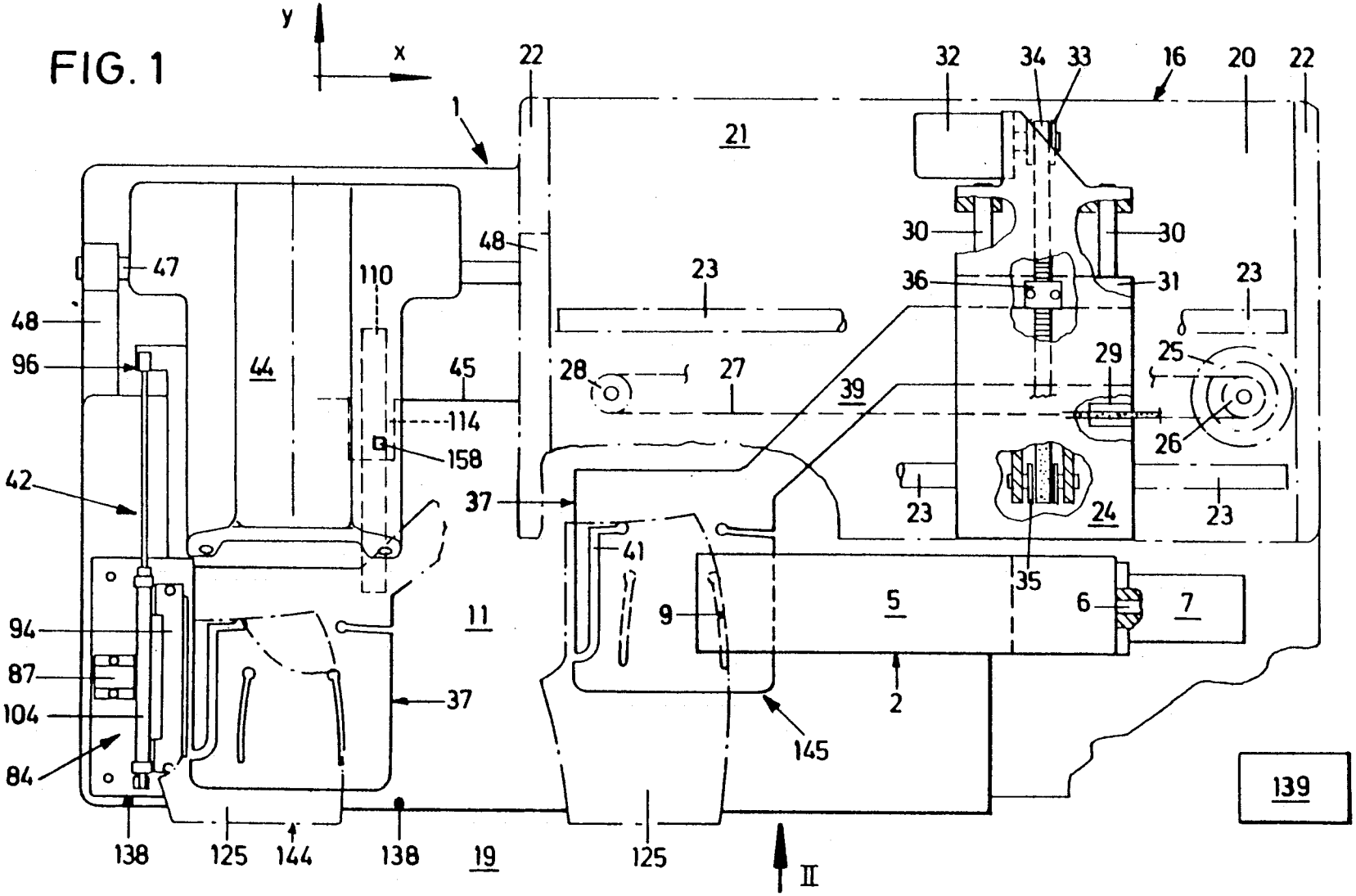
FIG. 1 is a plan view of a sewing unit.
Figure 2:
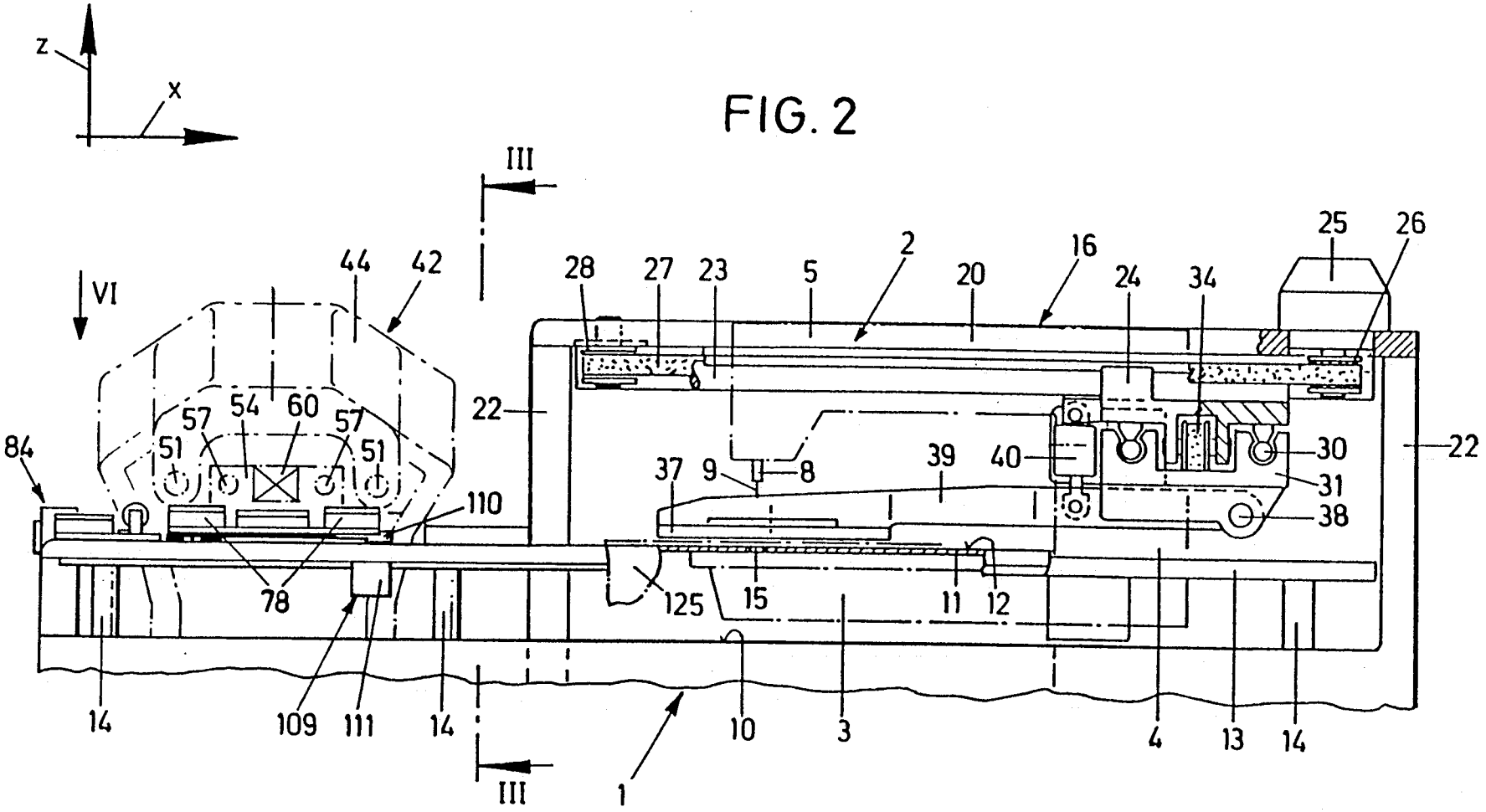
FIG. 2 is a front view of the sewing unit corresponding to the arrow II in FIG. 1.

The sewing unit, which is shown in FIGS. 1 and 2 and which in this case is an automatic sewing unit, has a stand 1 on which a sewing machine 2 is rigidly arranged. It consists in the customary manner of a base plate 3, a standard 4 and an upper arm 5. Mounted in the arm 5 of the sewing machine in the customary manner is an arm shaft 6 which can be driven by an electric sewing machine drive motor 7. The drive of a needle bar 8 and a needle 9 and, in addition, the drive of a hook (not shown in the drawing) situated in the base plate 3 are derived in the customary manner from the arm shaft 6.

A bearing plate 11 with an upper side defining a sewing plane 12 is arranged on the stand 1 above the upper side 10 of the latter. This bearing plate 11 is supported—at least partly—on a supporting plate 13 which is supported on the stand 1 by way of supports 14. This bearing plate 11 is also supported on the base plate 3 of the sewing machine 2 and, in the path of movement of the needle bar 8 and needle 9 defined as the z direction, has a stitch hole 15 which permits the passage of the needle 9 to the hook.

Above the bearing plate 11 there is provided a guiding device 16 for guiding workpieces which are to be sewn together and will be explained in even more detail further on. The device is—when seen from the operator's side 19—arranged behind the sewing machine 2. It has an upper base plate 20 which, in the rearward area 21 of the stand 1 opposite the operator's side 19, is supported—as seen from the operator's side—behind the bearing plate 11 on the stand 1 by way of vertical supporting walls 22. Attached to the underside of this base plate 20 are guide rods 23 which run parallel to one another in the x direction and on which a carriage 24 is mounted so as to be slidable in the x direction. This carriage 24 is driven by an electric motor 25 which in this case can be a geared motor, via a timing belt pulley 26 and an endless timing belt 27. The motor 25 and the timing belt pulley 26 are supported on the base plate 20. A deflection pulley 28 is likewise mounted in the base plate 20. The timing belt 27, which is arranged below the base plate 20 between the guide rods 23 and runs parallel to the latter, is connected to the carriage 24 by means of a securing device 29 which in this case is a clamping device.

Mounted on the underside of the carriage 24, designated as the x carriage, is a further pair of guide rods 30 which run in the y direction, i.e. perpendicular to the x direction, and parallel to one another and on which a further carriage 31 is slidably guided in the y direction. This carriage 31 is therefore designated as the y carriage. Both carriages 24, 31 are therefore guided suspended from respective guide rods 23 and 30. The y carriage 31 is driven by way of an electric motor 32—which, if necessary, is likewise in the form of a geared motor—and is attached to the x carriage 24 in the rearward area 21. It has a timing belt pulley 33 from which the y carriage 31 is driven via an endless timing belt 34. The timing belt 34 is guided parallel to the guide rods 30 via a deflection pulley 35 mounted on the underside of the y carriage 31, and is secured to the underside of the y carriage by means of a securing device 36. The x and y directions are perpendicular to one another and perpendicular to the z direction. The x, y and z directions therefore form a standard cartesian coordinate system. The x and y directions are parallel to the sewing plane 12. The x direction runs parallel to the main longitudinal direction of the sewing machine 2, i.e. parallel to the arm shaft 6.

A workpiece holder 37 is mounted on the underside of the y carriage 31 so as to be pivotable about a tilt axle 38 running parallel to the y direction. For this purpose the workpiece holder 37 is attached to the end of an angle lever 39, the other end of which is mounted on the tilt axle 38. As shown in FIGS. 1 and 2, the angle lever 39 is bent twice, that is, firstly, away from the workpiece holder 37 in the y direction towards the rear area 21 and, secondly, upwards in the z direction from the bearing plate 11 towards the underside of the y carriage 31. Between the tilt axle 38 and the workpiece holder 37 there is provided a lift and press drive 40 which, on the one hand, engages on the angle lever 39 and, on the other hand, on the y carriage 31. The drive in this case is a linear drive which is, customarily, in the form of a pneumatically operatable piston-cylinder drive. As is evident from the preceding text, the entire guiding device 16 is arranged together with all the associated components above the bearing plate 11, and can therefore be arranged very close to the sewing machine 2. The workpiece holder 37 has at least one slot 41 which follows the course of at least one seam to be produced, by means of which the two workpieces are to be sewn together.

The sewing machine 2 and the guiding device 16 are associated with a preparatory station 42 in which the workpieces are brought into the position relative to one another necessary for sewing. The preparatory station 42 has a folding device 43 in which a workpiece, which in this case is a trouser forepart, is brought together, when folded and correctly positioned, with the second workpiece which in this case is a strip of cloth with a zip-fastener component which, if necessary, is also previously folded. This folding device 43 has a cover-like carrier 44 which is arranged above the bearing plate 11 and projects partly above the latter towards the rear side 45 of the stand 1, the rear side 45 meaning the side opposite the operator's side 19. At its rear end the carrier 44 has a downwardly projecting lever arm 46. In the area where it passes into the lever arm 46, the carrier 44 is mounted so as to be pivotable about a tilt axle 47 which extends in the x direction and is supported in two bearing arms 48 which are mounted on the rear side 45 of the stand 1 and project from the stand towards the rear side 45 and in an upward direction. Engaging on the lower end of the lever arm 46 is a tilt drive 49 which in this case is a pneumatically operatable three-position piston-cylinder drive, and which therefore, apart from two end positions, can be positioned in an intermediate position, as a result of which the carrier 44 and thus a trouser part folding device 50 supported by this carrier can be positioned in three different tilt positions. The tilt drive 49 is supported on the rear side 45 of the stand 1.

Two guide rods 51 parallel to one another, which extend perpendicularly to the x direction and on each of which the trouser part folding device 50 is slidably guided by means of a sliding bearing 52 are arranged in the carrier 44. When the carrier 44 is in the upward and rearward pivoted position shown in FIG. 3, the guide rods 51 extend in the y direction approximately parallel to the bearing plate 11. A displacing drive 53 for the trouser part folding device 50, which drive engages on the slide bearings 52, is arranged on the carrier 44 above and between the guide rods 51. This displacing drive 53 is therefore a linear drive which, in this case, can be for example a pneumatic cylinder without a piston rod, as is commercially available under the name ORIGA. By means of this displacing drive 53 the trouser part folding device 50 can be brought into a position fully extended out of the carrier 44 towards the operator's side 19—as shown on the left side in FIG. 3—and into a position fully retracted into the carrier 44—as shown on the right side in FIG. 3.

Figure 3:
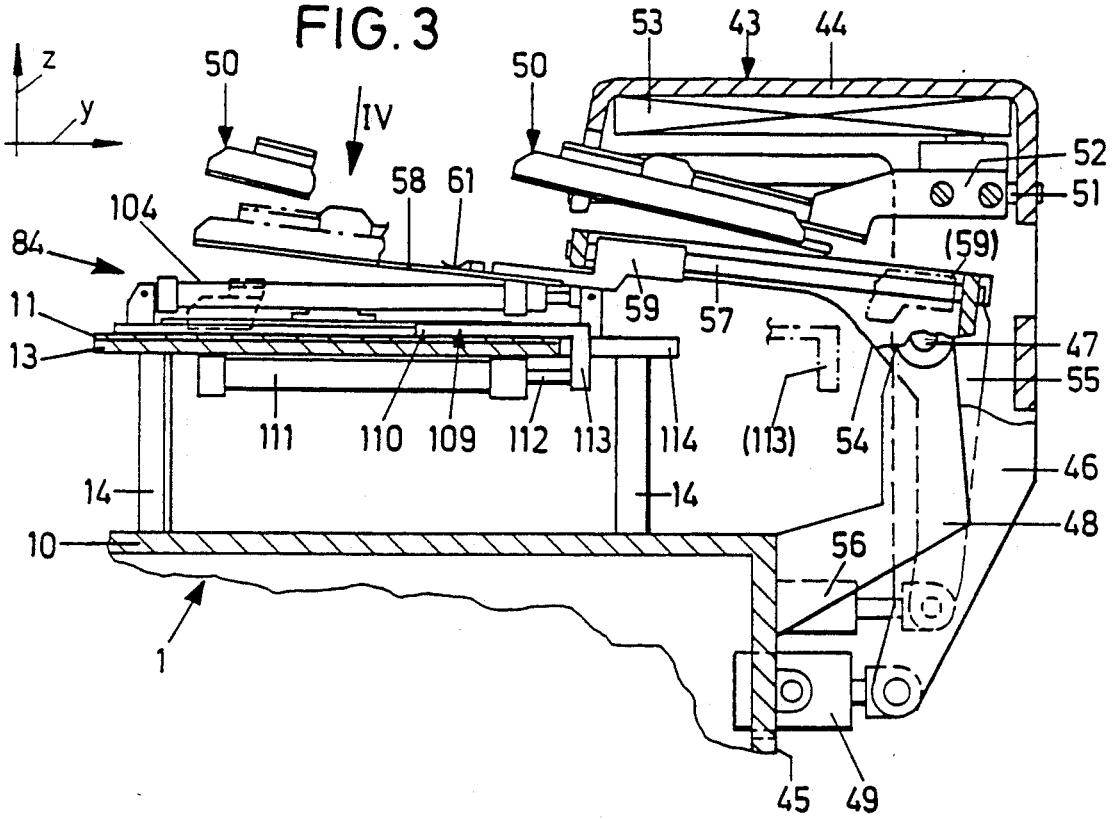
FIG. 3 is a cross-section through the sewing unit along the section line III—III in FIG. 2 which shows a partly broken-away side view of a preparatory station.

A sword carrier 54, which is arranged essentially below the cover-like carrier 44 and particularly below the guide rods 51 with the sliding bearings 52, is likewise mounted pivotably on the tilt axle 47. At the rear end of this sword carrier 54 there is formed a downwardly extending arm 55 which is arranged essentially inside the lever arm 46. Engaging on the lower end of this arm 55 is a sword tilt drive 56 by means of which the sword carrier 54 can be pivoted about the tilt axle 47. In the sword carrier 54 there are arranged—as can be seen in FIGS. 2 and 3—two guide rods 57 which are parallel to one another and extend essentially in the y direction and on which a sword 58 is mounted so as to be slidable by means of sliding bearings 59. The sword 58 is displaced by way of a sword displacing drive 60 which is arranged in the sword carrier 54 and can be designed identically to the displacing drive 53. Displacement takes place between two end positions, of which the extended position is shown on the left in FIG. 3, whereas the retracted position is indicated on the right in FIG. 3 by a part of the sliding bearing 59 being represented by dot-dash lines.

The sword 58 has on its upper side a material clamp 61 for securing a workpiece which, in the present case, is part of a pair of trousers.

The sword 58 has folding edges 62, 63 around which parts of trousers are folded in a manner not yet described, i.e. the sword 58 is part of the folding device 43.

Figure 4:
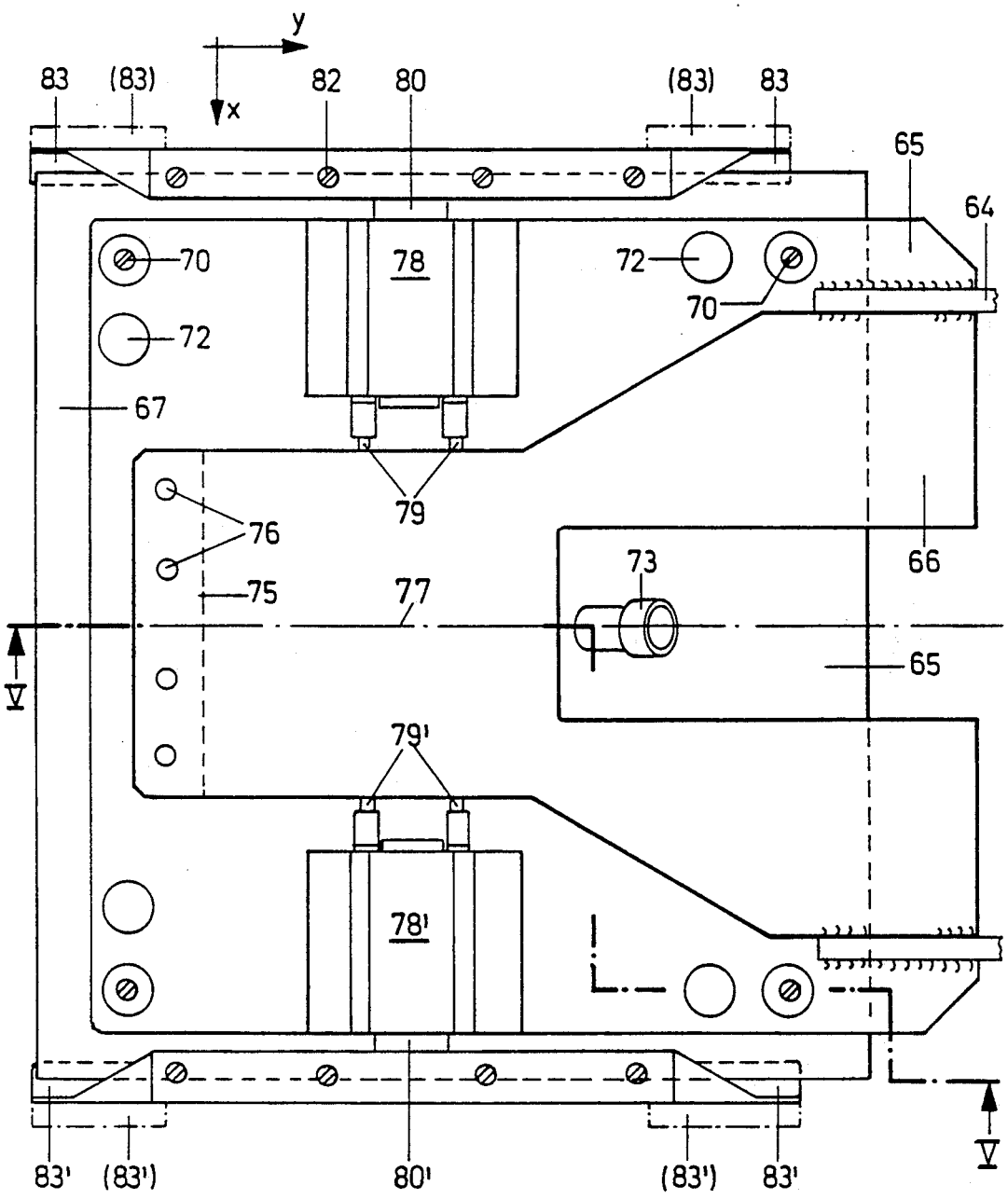
FIG. 4 is a plan view, on an enlarged scale, of a trouser part folding device in the direction of arrow IV in FIG. 3.
Figure 5:
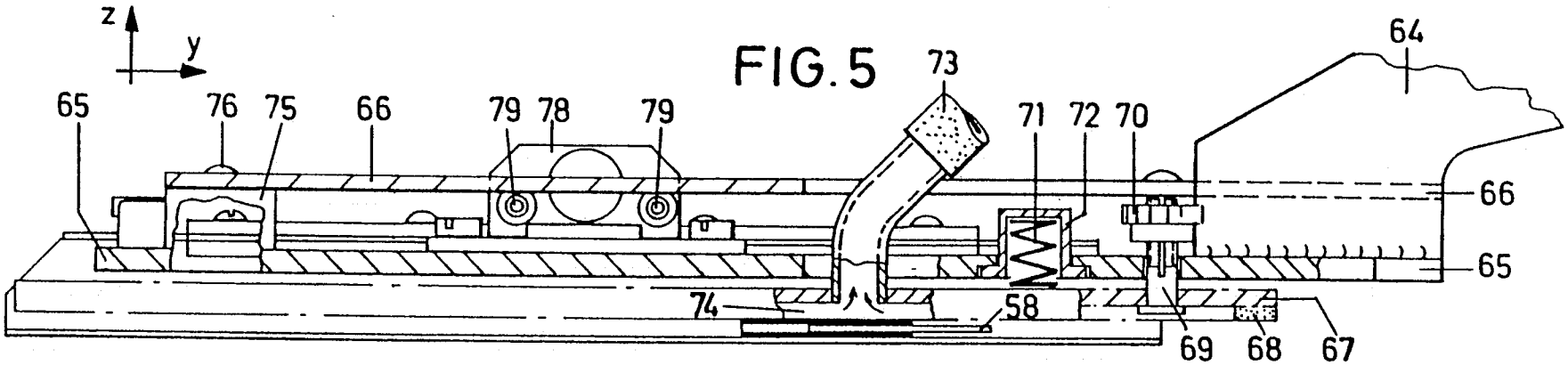
FIG. 5 is a side elevation, in an enlarged view broken away several times, of the trouser part folding device along the section line V—V in FIG. 4.

Details of the trouser part folding device 50 are evident from FIGS. 4 and 5. It has a supporting plate 65 connected to the sliding bearings 52 via webs 64 and a reinforcing plate 66 arranged above and parallel to this supporting plate. Below and parallel to the supporting plate 65 there is arranged a pressure plate 67 which, on its underside in the region of its outer circumference, is provided with a flexible seal 68. The pressure plate 67 is slidably guided by means of sliding bolts 69 in the pressure plate, the maximum spacing between the upper side of the pressure plate 67 and the lower side of the supporting plate 65 being adjustable in each case by a set screw 70 which can be screwed on to the corresponding sliding bolt 69 and is supported against the upper side of the supporting plate 65, as can be seen particularly from FIG. 5, on the right side. Between the upper side of the pressure plate 67 and the supporting plate 65 there are arranged pretensioned compression springs 71 which are in the form of helical springs and are supported in pot-shaped spring bearings 72 of the supporting plate 65 which project upwardly from the latter so that, on the one hand, the pressure plate 67 is forced into its maximum possible spacing position, according to the setting of the set screw 70, below the supporting plate 65, but on the other hand can be deflected upwards towards the supporting plate 65 in opposition to the force of these compression springs 71.

A vacuum connection 73 connected to a vacuum source (not shown) is fitted on the pressure plate 67 so that, when a seal 68 is fitted on to the sword 58 with appropriate vacuum actuation and so as to create a seal, a suction chamber 74 is formed inside this encircling seal 68 and below the pressure plate 67. By this means a vacuum-type retaining device for the sword 58 is therefore formed.

At its end remote from the webs 64, the reinforcing plate 66 is connected to the supporting plate 65 via an intermediate piece 75 and a riveted joint 76.

Figure 8:
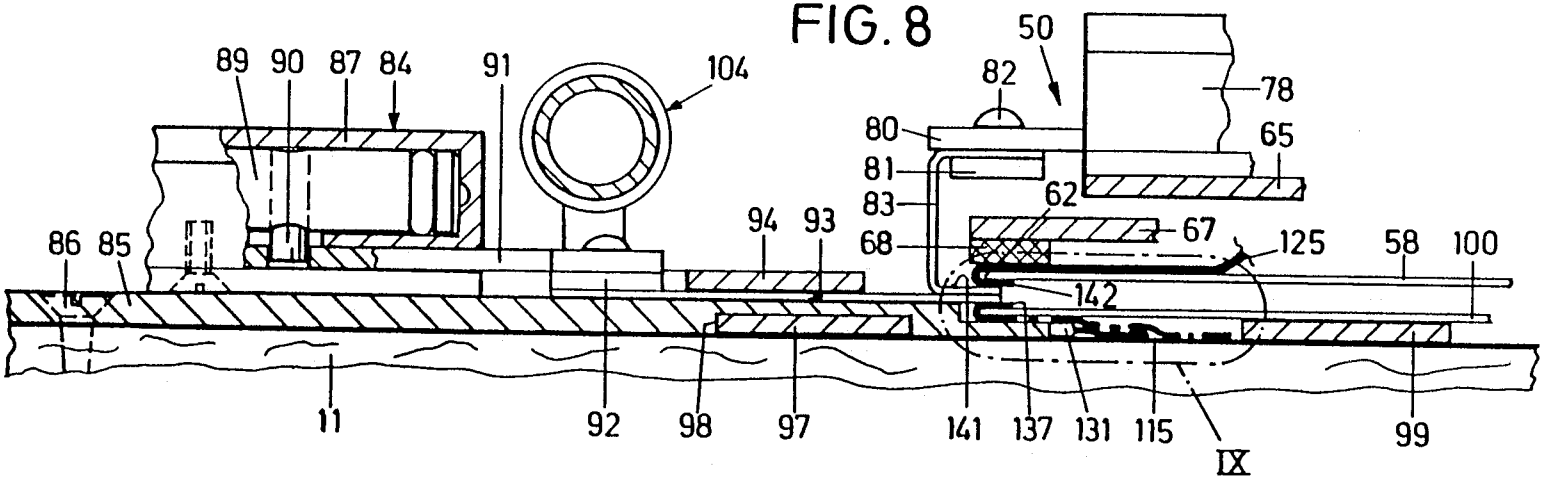
FIG. 8 is a cross-section through the folding unit along the section line VIII—VIII in FIG. 6 and a partial view, also in cross-section, of the trouser part folding device.

Mounted on the upper side of the supporting plate 65 on both sides of the central axis of symmetry 77 are two displacing modules 78, 78', as they are commerically available. They are connected to pneumatic connections (not shown) via connecting lines 79, 79'. C-shaped folding edges 83, 83' are attached to their respective sliding parts 80, 80' by means of a fastening strip 81, 81' and screws 82, which folding edges can be displaced in the x direction by respective modules (in this connection see FIGS. 4, 8 and 9). The two end positions of displacement of the folding edges 83, 83' are indicated at the top right and bottom left, respectively, in FIG. 4.

Situated below the trouser part folding device 50 and, accordingly, also below the sword 58 is a left folding unit 84 by means of which a strip of cloth serving as a workpiece is folded with a left zip-fastener component. This left folding unit 84 has a supporting plate 85 which rests on the bearing plate 11 and is rigidly secured thereon by means of screws 86. A displacing module 87, the pneumatic connecting lines 88 of which lead to a compressed air source (not shown) is secured on the supporting plate 85. Attached to the piston 89 (shown in more detail in FIG. 8) of the displacing module 87 by means of a connecting pin 90 is a sliding part 91 to which a flat folding plate 93 is turn attached via an intermediate strip 92, which folding plate is on the one hand supported on the supporting plate 85 and secured to prevent upward deflection by a guiding part 94. As can be seen from FIG. 6, the guiding part 94 projects above the folding plate 93 in the y direction and is connected at this point in each case to the supporting plate 85 by means of screws 95.

A U-shaped slider 96, which is displaceable in the y direction away from the operator's side 19, is fitted also as part of the left folding unit on the bearing plate 11. A guide leg 97 of this slider 96 is guided in a guide groove, which has a matching cross-section and extends in the y direction, in the underside of the supporting plate 85, i.e. between the latter and the bearing plate 11. A folding sword 100 is attached to the other leg of the slider 96 which serves as the transfer leg 99. A piston rod 103 of a pneumatically operatable piston-cylinder drive 104 is connected to the web 101 or to an extension 102 of this web 101 by means of a joint 105. The cylinder 106 of the drive 104 is also connected by means of a joint 107 to the supporting plate 85 adjacent to the operator's side 19. The drive 104 which can be operated in either direction is connected to a pneumatic source (not shown) by means of pneumatic connecting lines 108. When the piston rod 103 is extended out of the cylinder 106, the slider 96 is moved into the position which is indicated by dot-dash lines on the right in FIG. 6 and in which the transfer leg 99 and folding sword 100 are not situated adjacent to the folding plate 93, and no longer overlap with this folding plate. In this case the corresponding reference numerals are once more indicated in brackets.

Figure 9:
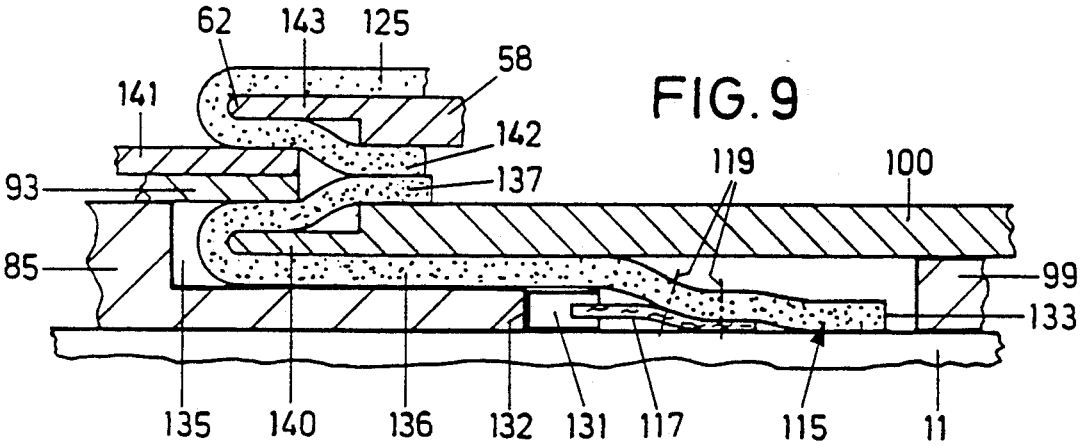
FIG. 9 shows, on a clearly enlarged scale, a detail which is outlined in dot-dash lines in FIG. 8 and designated by IX.

Offset in the x direction from the left folding unit 84 towards the sewing machine 2, there is also provided in the area of the bearing plate 11 a positioning unit 109 which is associated with the right folding edge 83', as can be seen from FIG. 9. It has a stop shoulder 110 which is displaceable in the y direction parallel and in the same direction as the transfer leg 99 and which rests on the bearing plate 11. Parallel to its direction of displacement in the y direction, a displacing drive 111 in the form of a piston-cylinder drive is fitted on the underside of the supporting plate 13, the piston rod 112 of this displacing drive being connected to the stop shoulder 110 via a driver 113. Over part of its path from the positioning position of the stop shoulder 110, which is shown by unbroken lines on the left in FIG. 3, into the extended position, indicated by the dot-dash lines on the right in FIG. 3, the driver 113 passes through a recess 114 in the supporting plate 13 and bearing plate 11.

Before the mode of operation of the described sewing unit and the method used in this operation are explained in detail, the fundamental sewing technique problems are described with the aid of FIGS. 11 to 14. There are a left strip of cloth 115 (FIG. 11*a* and FIG. 12*a*) and a right strip of cloth 116 (FIG. 11*b* and FIG. 12*b*). A left zip-fastener component 117 and a right zip-fastener component 118 are sewn on to these cloth strips 115, 116 by means of double seams 119 and 120, respectively. On its edge which is to be no longer folded over, the left cloth strip 115 is provided with a finishing seam 121. The right cloth strip 116 is in two layers and projects with a folded edge 122 over the teeth 123 of the right zip-fastener component 118. A finishing seam 124 is also attached in the area of the other edge. The left cloth strips 115 and right cloth strips 116 which are formed in this manner are in principle continuously prefabricated and are cut to form pieces of the required length, as shown in FIGS. 11*a* and 11*b*. It should also be noted that during the prefabrication of the cloth strips the teeth of the zip-fastener components are removed over a range of 1 to 2 cm at each strip end.

Figure 13:
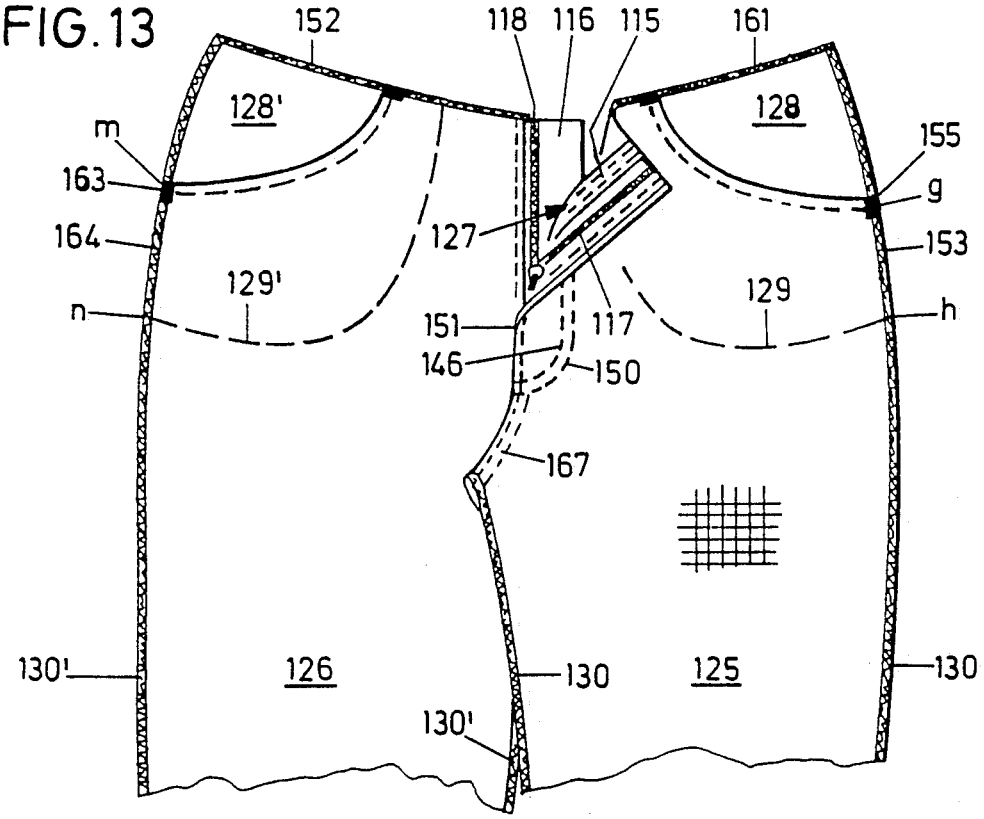
FIG. 13 is a plan view of sewn together trouser foreparts having a fly.
Figure 11A:
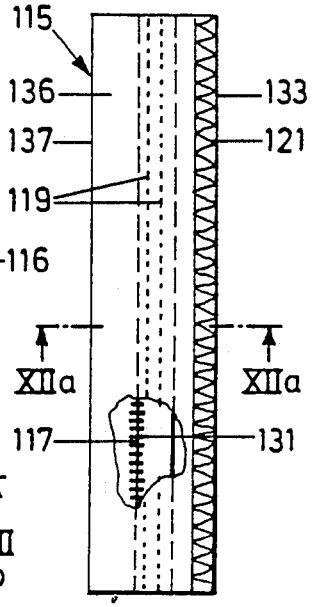
Figure 11B:
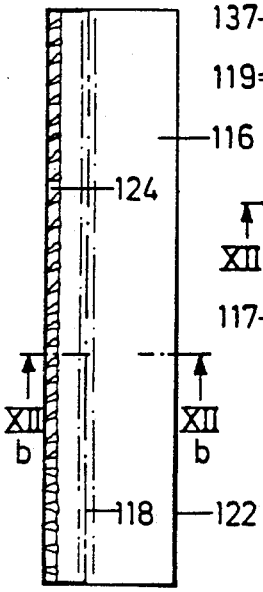
Figure 14:
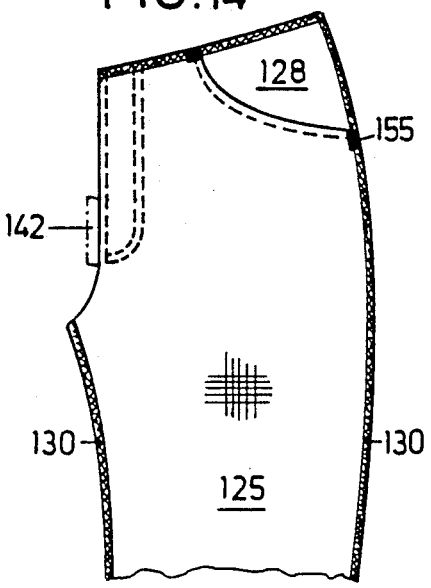
FIG. 14 shows a left trouser forepart in a finally sewn state.

The left cloth strip 115 with the left zip-fastener component 117, which is also designated as the fly lining, is to be sewn into a left trouser forepart 125, while the right cloth strip 116 with the right zip-fastener component 118, which is also designated as the fly underpart, is to be sewn into a right trouser forepart 126. After the left trouser forepart 125 and right trouser forepart 126 are sewn together, they form a trouser forepart which is shown in FIG. 13 and which, after being joined to the two rear parts of the trousers, form a complete pair of trousers. After the two trouser foreparts 125, 126 are sewn together, a trouser fly 127 provided with a zip fastener is formed.

The two trouser foreparts 125, 126 are provided with, respectively, pocket mouths 128, 128' and pocket pouches 129, 129'. The trouser foreparts 125, 126 are neatened along their longitudinal edges essentially with finishing seams 130, 130', respectively.

Figure 6:
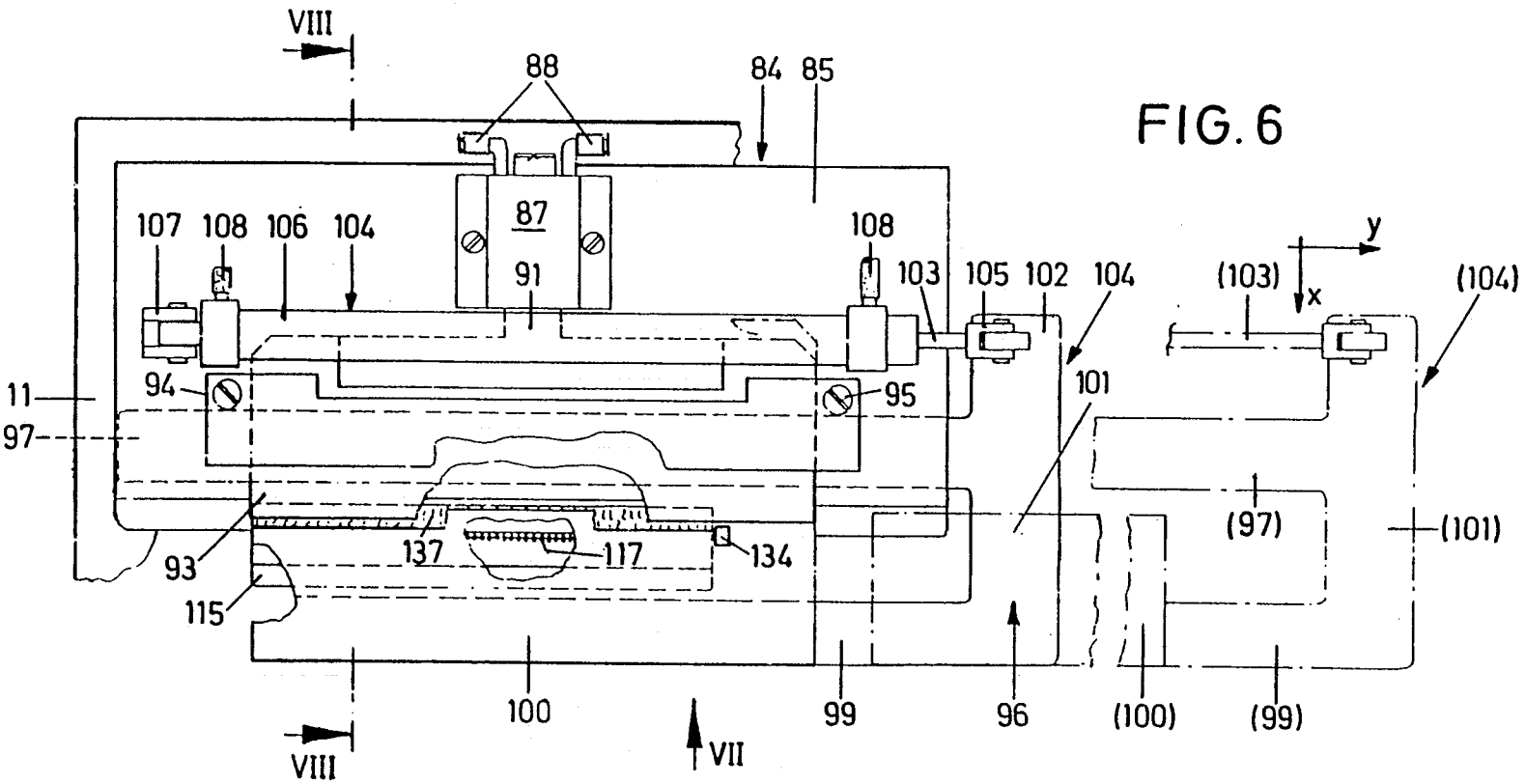
FIG. 6 shows on an enlarged scale a plan view of a cloth strip folding unit in the direction of arrow VI in FIG. 2.
Figure 7:
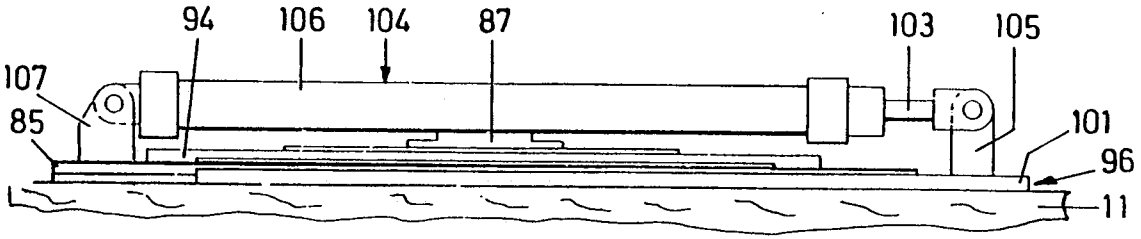
FIG. 7 is a partial side view of the folding unit in the direction of arrow VII in FIG. 6.

The sewing of a left cloth strip 115 and left zip-fastener component 117 on to a left trouser forepart 125 is described below, and in this connection reference to the left cloth strip 115 always means such a strip having the corresponding zip-fastener component 117. When the preparatory station 42 is in the initial position, the trouser part folding device 50 and the sword 58 are situated in their position moved away from the operator's side 19 towards the rear side 45. Also, the folding plate 93 of the left folding unit 84 is in a retracted position, as indicated by dot-dash lines in areas in FIG. 6, and in addition the folding sword 100 is situated in the position directed towards the operator's side 19, as shown in FIG. 6. In addition, the stop shoulder 110 of the right positioning unit 109 is in this case also displaced into its rearward, i.e. inactive position.

Directly above the contact edge 132 there is provided in the supporting plate 85 a recess 135 within which lies the area 136 of the left cloth strip 115, the associated edge 137 of which is to be folded over. The elastic bending behaviour of the transfer leg 99 and folding sword 100 regarding its position relative to the bearing plate 11 makes it possible to draw the left cloth strip 115 under the folding sword 100 from the operator's side 19, the teeth 131 of the zip-fastener component 117 coming into contact with a contact edge 133 of the supporting plate 85. At the same time the cloth strip is aligned in the longitudinal direction (y direction) with the aid of a visual marking or a visual stop 134 on the supporting plate 85. Following this operation to insert the left cloth strip 115, its area 136 bordering the edge 137 has already occupied a position extending in the z direction because of the action of the edge in the supporting plate 85 defining the recess 135.

After the left cloth strip 115 is positioned, the operator triggers by means of a two-hand control switch 138 the operation of the displacing module 87 by compressed air by way of a computer 139 serving to control the entire sewing unit, so that the folding plate 93 is pushed over the recess 135 so that the area 136 with the edge 137 of the left cloth strip is fully turned over, that is on to a folding web 140 which is tapered in relation to the folding sword 100. As can be seen from FIG. 9, the sum of the double thickness of the cloth strip 115 and the thickness of the folding web 140 is approximately equal to the depth of the recess 135. The edge 137 still rests on the upper side of the folding web 100, i.e. not on the tapered folding web 140.

Then the sword displacing drive 60 is subjected to compressed air by repeated operation of the two-hand control switch 138 so that the sword carrier 54 and sword 58 are displaced out of the retracted into the extended position, as shown in FIG. 3. In this case the sword 58 is situated in its upwardly pivoted position above the left folding unit 84. The left trouser forepart 125 is now placed on the sword 58 and retained on the material clamp 61. It is aligned relative to the folding sword 58. Triggering of the displacing drive 53 of the trouser part folding device 50 is initiated via the computer 139—again by operating the two-hand control switch 138, which folding device is thereby moved into its position above the left folding unit 84, and in this connection it is in the fully upwardly tilted position as shown in FIG. 3. In this case the tilt drive 49 is therefore fully retracted. Then, by corresponding actuation of the tilt drive 49, the trouser part folding device 50 is lowered into its central pivot position, i.e. the tilt drive 49 occupies its central position. The folding device 50 is now situated on the sword 58 with the left trouser forepart 125. The seal 68 of the pressure plate 67 rests in this case on part of the left trouser forepart 125 and, above it, again on the sword 58, as can be seen for example in FIG. 5 and particularly in FIG. 8. By means of vacuum operation of the suction chamber 74 via the vacuum connection 73, the sword 58 together with the left trouser forepart 125 is drawn by suction towards the pressure plate 67 and fixed opposite and retained by this plate, whereby the position of the left trouser forepart 125 is also fixed.

In this state the area adjacent to the edge 142 to be folded over has already occupied a position running in the z direction, i.e. the edge 142 is angled towards the bearing plate 11. This angling of the edge 142 is achieved as a result of the lower horizontal folding leg 141 of the folding strip 83 cooperating with the folding edge 62 of the sword 58.

By means of a sequence control system the displacing module 78 is actuated via the computer 139 so that the edge 142, to be folded over, of the left trouser forepart 125 is folded around the folding edge 62 of a tapered folding web 143 of the sword 58 by the lower horizontal folding leg 141 of the C-shaped folding strip 83. By means of a further sequence control the displacing drive 53 and also the sword tilt drive 56 are triggered so that the trouser part folding device 50 and the sword 58 are pivoted into their lowered position whereby the folded left trouser forepart 125 is fitted on to the folded left cloth strip 115, as can be seen particularly in FIG. 9.

The displacing modules 78 and 87 are subsequently actuated in the reverse direction by means of a sequence control triggered by the computer 139 so that the folding plate 93, on the one hand, and the folding strip 83 and folding leg 141, on the other hand, are drawn out of their folding position shown in FIG. 9. However, the left trouser forepart 125 and the left cloth strip 115 are thereby left in their positioned position folded towards one another because their folded-over edges 137 and 142 remain clamped between the sword 58 and the supporting plate 85. The tilt drive 49 is subsequently triggered so that the trouser part folding device 50 is tilted upwards into its position shown at the top left in FIG. 3. It is subsequently moved back into its rearward position under the carrier 44 by appropriate triggering of the displacing drive 53.

The workpiece holder 37 is now moved by appropriate triggering of the motors 25 and 32 over the left trouser forepart 125 in its position, referred to as the transfer position 144, in the preparatory station 42, as indicated in FIG. 1. The lift and press drive 40 is in this case extended so that the workpiece holder 37 is freely situated above the bearing plate 11 and freely above the parts still in the area of the transfer position 144. It is lowered by appropriate triggering of the lift and press drive 40 and set from above on to the left trouser forepart 125 and the left cloth strip 115 situated below the latter. By corresponding triggering of the sword displacing drive 60 the sword 58 is drawn back into the position below the carrier 44. In addition, appropriate actuation of the drive 104 causes the slider 96 to be moved back with the folding sword 100 into its position shown by dot-dash lines in FIG. 1 so that the folded trouser forepart 125 and the cloth strip 115 are only pressed on to the bearing plate 11 by the workpiece holder 37 and no other parts act as obstacles on the bearing plate between the transfer position 144 and a sewing position 145 under the sewing machine 2. After the workpieces are transfered to the sewing machine 2, the left cloth strip 115 and the left trouser forepart 125 are sewn together on this machine in a single operation, that is beginning at point a a first seam section 146 is sewn inside the slot 41 of the workpiece holder 37 as far as point b. From there a cross seam 147 is sewn as far as point c where a bar tack 148 is sewn. From this point a cross seam 149 is again sewn parallel to cross seam 147 back as far as point d which is adjacent to point b. From there a seam section 150 parallel to seam section 146 is sewn as far as point e which is adjacent to point a. The seam sections 146 and 150 therefore create the impression of a double seam; they are J-shaped, and therefore have lower bent corners. Then from point e by way of point a an outer seam 151, which is essentially parallel to seam sections 146 and 150, is sewn as far as point f which is approximately on a level with point b on the upper edge 152 of the left trouser forepart 125.

From this point the workpiece holder 137 and the left trouser forepart 125—being controlled by the computer 139—can be guided even further so that a further part seam 153 is sewn through a slot 154 of the workpiece holder, by which seam the pocket pouch 129 and the left trouser forepart 125 are partly sewn together. The seam starting and finishing points of this seam section 153 are designated by g and h. At the starting point g of this part seam 153, i.e. adjacent to the pocket mouth 128, a bar tack 155 is sewn.

After these seams are finally sewn, the workpiece holder is guided out of the sewing position 145 towards the operator's side 19 and the lift and press drive 40 is actuated so that the workpiece holder 37 is lifted clear of the bearing plate 11. The so far completed left trouser forepart 125 can then be removed by the operator.

Figure 10:
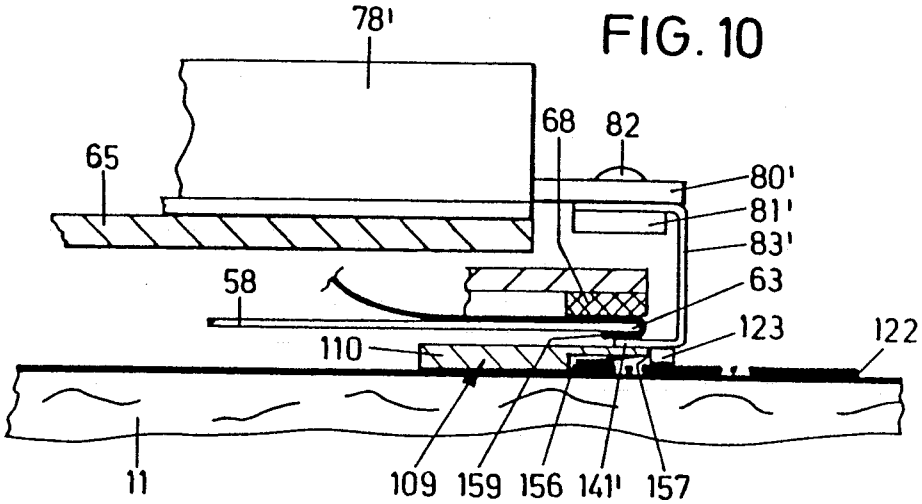
FIG. 10 is a cross-sectional view through a positioning unit, with a partial cross-section of the trouser part folding device in a view corresponding to FIG. 8, FIGS. 11*a* and *b* are plan views of a left cloth strip and a right cloth strip, each provided with a zip-fastener component, FIGS. 12*a* and *b* are cross-sections through the cloth strips along the section lines XIIa—XIIa and XIIb-XIIb in FIGS. 11*a* and *b*, respectively.
Figure 12A:
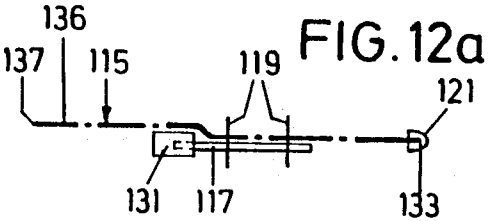
Figure 12B:
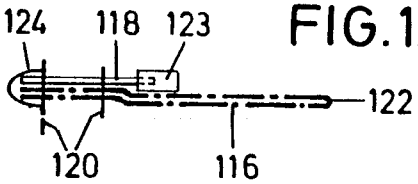

The positioning of a right cloth strip 116 and a right zip-fastener component 118 relative to a right trouser forepart 126 proceeds in a similar manner so that only differing working steps are described. The stop shoulder 110 is situated in its position at the transfer position 144 while the trouser part folding device 50 and the sword 58 are in their retracted position. The right cloth strip 116 is—as can be seen in FIG. 10—inserted into a recess 156 in the stop shoulder, which recess is open towards the bearing plate 11, so that the teeth 123 bear against a contact edge 157, i.e. they are positioned. In this case the folded edge 122 lies open in the direction of the sewing machine 2. The cloth strip 116 is in this case fixed in the longitudinal direction by an, if necessary, visual stop 158. The extension of the sword 58, the placing of the right trouser forepart 126 on this sword, the extension and lowering of the trouser part folding device 50 on to the sword 58, the fixing of these parts by vacuum, the angling of the edge 159 of the right trouser forepart 126 as a result of the lower horizontal folding leg 141' of the C-shaped folding strip 83' cooperating with the folding edge 63 of the sword 58, the folding of the edge 159 of the right trouser forepart 126 around the folding edge 63 of the sword 58 by means of the folding leg 141' of the C-shaped folding strip 83', the drawing out of the folding leg 141' by actuation of the displacing module 78' and the upward tilting and retraction of the trouser part folding device 50 proceed in the same way as already described above with reference to the left trouser forepart 125. Likewise the advance and lowering of the workpiece holder 37 and the extension of the sword 58 proceed as already described above. At the same time as the extension of the sword 58, the stop shoulder 110 is moved out of the transfer position 144 into the rearward position also by appropriate actuation of the displacing drive 111. The right trouser forepart 126 with the folded-over edge 159 and the right cloth strip 116 positioned relative thereto is transferred in the described manner by means of the guiding device 16 into the sewing position 145 where these parts are sewn together. For this purpose, starting from a point i, an outer seam 160 is sewn as far as and into the area of the upper edge 161 of the right trouser forepart 126, that is as far as a point k. From there a cross seam 162 is sewn as far as a point l where the sewing operation is completed with a bar tack 163. This sewing operation can be followed in the same clamping fixture by the sewing of a part seam 164 which corresponds to the part seam 153. For this purpose a corresponding slot 165 is then provided in the workpiece holder 37. Again in this case this part seam 164 is started at a point m with a bar tack 166 and finished at a point n. Also, this part seam 164 serves partially to attach the pocket pouch 129' to the right trouser forepart 126 and extends downwards from the pocket mouth 128'. The delivery of the right trouser forepart 126 after sewing proceeds in the described manner. The left trouser forepart 125 and the right trouser forepart 126 can be connected to form a complete trouser front by a joining seam 167 below the trouser fly 127.

Whereas the workpiece holder 37 is designed in such a manner that it can be used for example to sew alternately left trouser foreparts 125 and right trouser foreparts 126, the workpiece holder 168 shown in FIG. 16 is designed only for sewing left trouser foreparts, and in this case there is again provided a slot 169 for sewing a J-shaped double seam which therefore corresponds to the two seam sections 146, 150. In this connection runout areas 170, 171 are provided for different trouser sizes. With this form of workpiece holder 168 a connecting channel 173 between the runout areas 170 and 171 is omitted for the purpose of secure clamping of the workpiece so that the seam sections can be produced separately, with intermediate thread cutting operations, but in one clamping fixture. A runout area 173 is also provided for seams of different sizes corresponding to the additional part seam 153. The runout areas 170, 171, 173 are represented by broken lines in FIG. 16.

Figure 17:
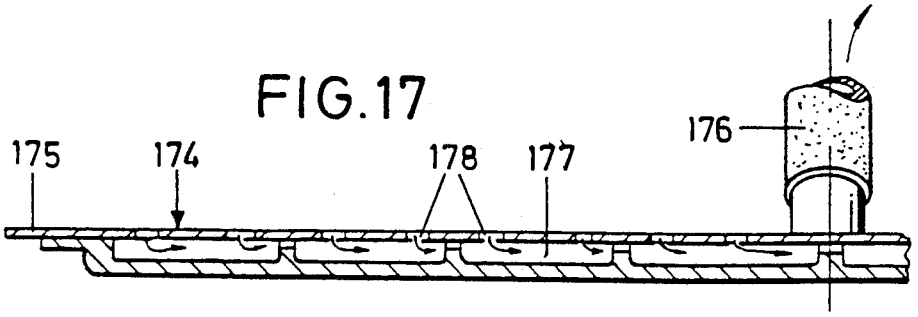
FIG. 17 shows a sword with a vacuum-type retaining device.

FIG. 17 shows in cross-section an embodiment of a sword 174 which in this case is an alternative to the sword 58. In this case a vacuum chamber 177 connected to a vacuum connection 176 is formed below the actual plate 175 for supporting the—in this case left—trouser forepart. Suction openings 178 are formed in the supporting plate 175. The embodiment with the vacuum chamber 177 is only situated in the area which does not overlap with the associated cloth strip. The area which overlaps with the cloth strip—shown on the left in FIG. 17—is very thin in design—as in the exemplary embodiment described above. The advantage of this design is that the trouser forepart on the sword 174 can, on the one hand, be displaced for positioning, but on the other hand is retained in the positioned position because of the vacuum.

What is claimed is:

1. A method of attaching a strip of cloth provided with a zip fastener component to a trouser forepart, comprising the following steps:

an edge of the trouser forepart is folded over;

an edge of the strip of cloth is folded over;

the folded-over edge of the strip of cloth and the folded-over edge of the trouser forepart are brought into mutual contact;

the trouser forepart with the folded-over edge and the strip of cloth with the folded-over edge are positioned relative to one another in a position which they occupy after being joined together; and the trouser forepart and the strip of cloth are joined by means of a seam effected in a single sewing operation.

2. A method according to claim 1, wherein the seam joining the trouser forepart and strip of cloth is sewn in the form of only one continuous seam comprising a plurality of seam sections.

3. A method according to claim 1, wherein, on the trouser forepart, a pocket is provided which is sewn together with the trouser forepart, and wherein at least a one part seam for joining the pocket to the trouser forepart is produced immediately following, in time, the production of the seam between the trouser forepart and strip of cloth.

4. A method according to claim 1, wherein on the trouser forepart a pocket is provided which is sewn together with the trouser forepart, and wherein at least a one part seam for joining the pocket to the trouser forepart is produced immediately following, in time, the production of the seam between the trouser forepart and strip of cloth.

* * * * *